United States Patent [19]

Klein

[11] Patent Number: 4,693,204

[45] Date of Patent: Sep. 15, 1987

[54] SIDE FACING BACKREST FOR BOATS

[76] Inventor: Robert A. Klein, 6610 N. Yuba St., Milwaukee, Wis. 53223

[21] Appl. No.: 922,485

[22] Filed: Oct. 23, 1986

[51] Int. Cl.[4] ..... B63B 25/00

[52] U.S. Cl. ..... 114/363; 297/350; 297/315

[58] Field of Search ..... 114/363; 297/352, 353, 297/354, 378, 452, 252, 350, 42, 44, 460, 315; 280/47.4

[56] References Cited

U.S. PATENT DOCUMENTS

| | | | |
|---|---|---|---|
| 2,247,269 | 6/1941 | Ashbacker | 297/352 |
| 2,619,157 | 11/1952 | Guyton et al. | 297/353 |
| 4,611,852 | 9/1986 | Filer | 297/352 |

*Primary Examiner*—Joseph F. Peters, Jr.
*Assistant Examiner*—Edwin L. Swinehart
*Attorney, Agent, or Firm*—Wheeler Law Firm

[57] ABSTRACT

A two-piece collapsible backrest for use in boats. The backrest's novel design allows it to be adjusted to a variety of widths.

7 Claims, 4 Drawing Figures

SIDE FACING BACKREST FOR BOATS

SUMMARY OF THE INVENTION

The present invention is a two-piece backrest primarily for use in boats. Each piece of the backrest is a mirror image of the other piece, and each piece has a back part and attached side part. Holes for fasteners are provided in the back of each of the pieces of the backrest to allow the backrest to be assembled in a variety of widths. The sides of the assembled backrest allow the backrest to be fastened to a boat in such a way that the backrest can be rotated from a collapsed position, parallel to the bottom of the boat, to an upright position at a right angle or an obtuse angle to the bottom of a boat. In its folded position it fits the seat so closely that it serves as the seat surface, permitting the seat to be used at all times.

The invention has the advantages over prior backrest for boats of being easy to assemble, being easy to store when not in use because no separate storage is required, and being capable of being adjusted to a variety of widths. Although the backrest is described as being used in boats, it can also be used to provide a backrest for other structures, such as for use on a see-saw.

DRAWINGS

Figure 4:
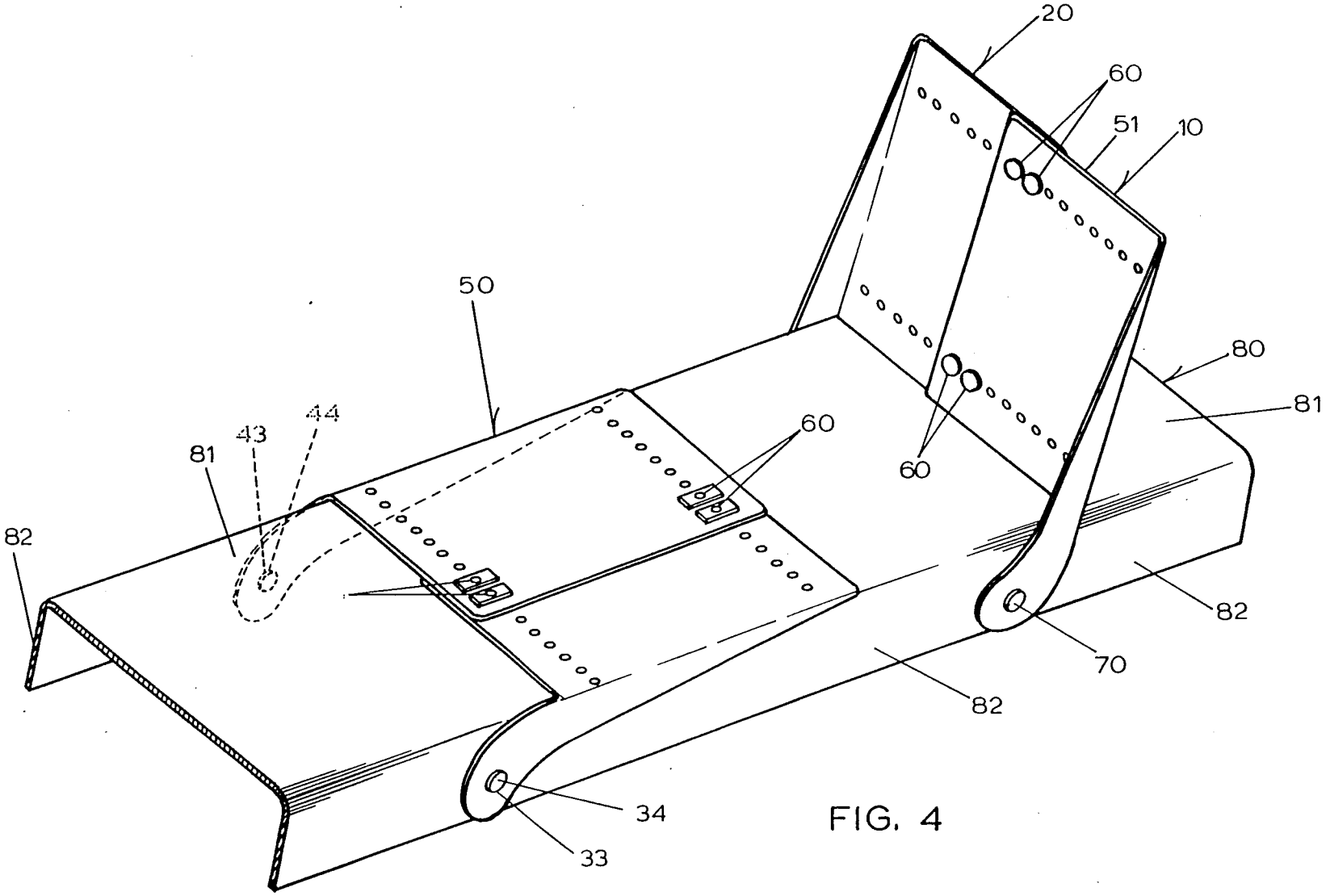

FIG. 4 is a right perspective view of the assembled backrest shown attached to a seat, such as a cross beam in a boat. The backrest on the left is shown in a folded position. The backrest is shown in an upright position.

DETAILED DESCRIPTION

Although the disclosure hereof is detailed and exact to enable those skilled in the art to practice the invention, the physical embodiments herein disclosed merely exemplify the invention which may be embodied in other specific structure. While the best known embodiment has been described, the details may be changed without departing from the invention which is defined by the claims appended hereto.

Figure 1:
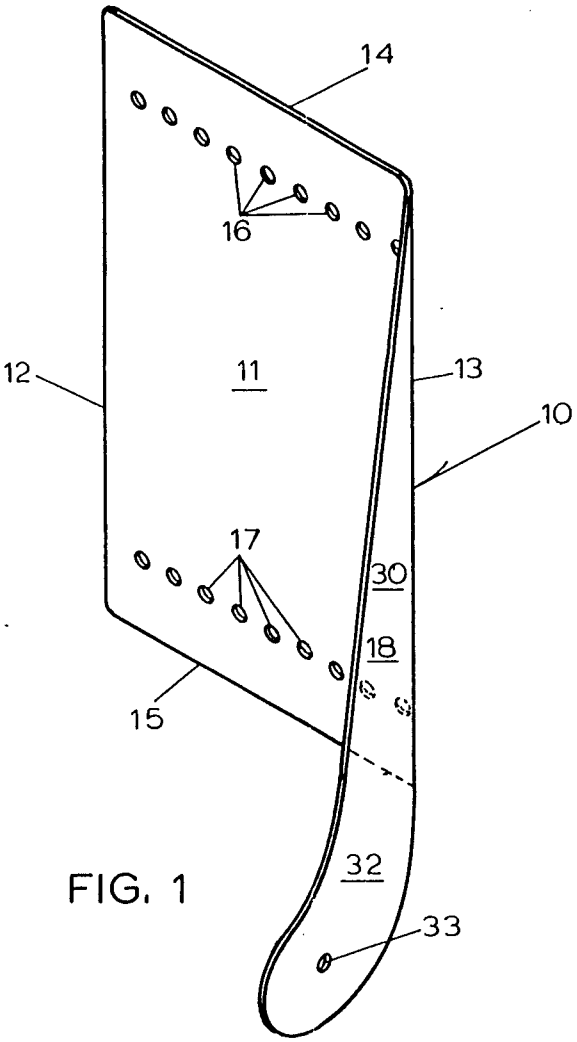
FIG. 1 is a right perspective view of the right member of the backrest.

As seen in FIG. 1, the right backrest section 10 has two main parts: a back panel 11 and a side panel 18, connected to back panel 11 by a substantially right angle bend 13. The back panel 11 has a top edge 14, a bottom edge 15, and a free edge 12. The back panel 11 also has two sets of openings, 16 and 17, which are shown substantially parallel to the top edge 14 and bottom edge 15. Preferably, for each opening 16 at the top of the back panel 11, there is a corresponding opening 17 below it. The side panel 18 consists of two principal portions: a top portion 30 located above where the bottom edge 15 and side panel 18 meet, and an extended portion 32 which is located below where the bottom edge 15 and side panel 18 meet. While as seen in this figure the top portion 30 comes to a point where it meets the top edge 14, the shape of the top portion 30 is not critical to the invention. As seen in this figure, the bottom section 32 angles out from the rest of the side panel 18. The exact shape of the extended portion 32 is not critical to the invention, as long as the extended portion 32 projects substantially out from the plane of the back panel 11 so that the opening 33 and the extended portion 32 is substantially forward of the plane of the back panel 11, to give the pivot point a location forward of the back panel to stiffen the side panel against rearward forces on the back panel.

Figure 2:
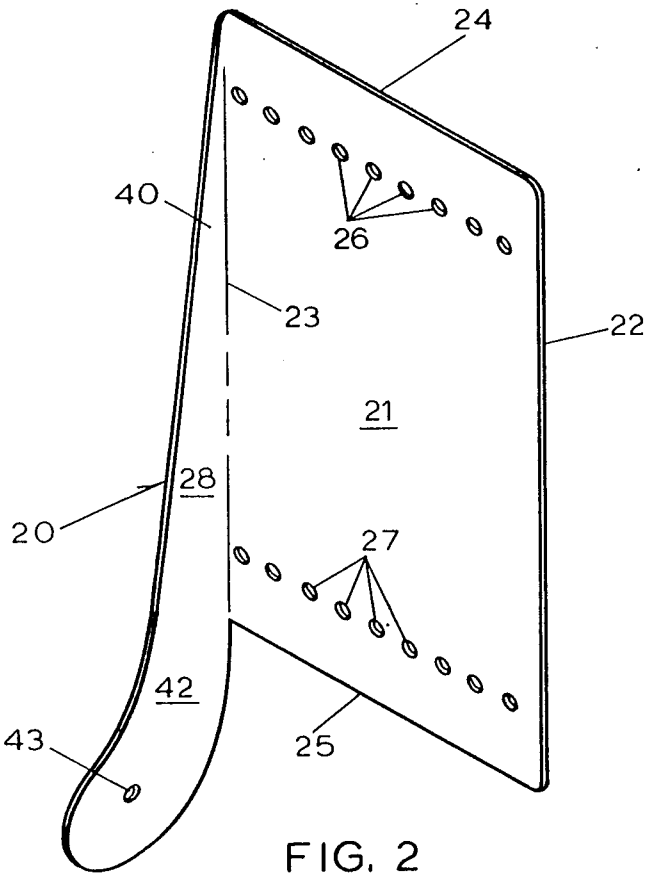
FIG. 2 is a right perspective view of the left member of the backrest.

As seen in FIG. 2, the left backrest section 20 is a mirror image of the right backrest section 10. The left backrest section 20 likewise has two main parts: a back panel 21 and a side panel 28 connected to the back panel 21 by a substantially right angle bend 23. The back panel 21 has a top edge 24, a bottom edge 25, and a free edge 22. The back panel 21 also has two sets of openings 26 and 27 which are shown as parallel to the top edge 24 and bottom edge 25. Preferably, for each opening 26 at the top of the back panel 20, there is a corresponding opening 17 below it. Also, for every opening 26 on the left backrest section 20, there is a corresponding opening 16 on the right backrest section 10, and for every opening 27 on the left backrest section 20, there is a corresponding opening 17 on the right backrest section 10.

The side panel 28 consists of two principal portions: top portion 40 located above where the bottom edge 25 and the side panel 28 meet, and an extended portion 42 which is located below where the bottom edge 25 and side panel 28 meet. While as seen in this drawing, the top portion 40 comes to a point where it meets the top edge 24, the shape of the top portion 40 is not critical to the invention as long as it is sufficient to brace rear panel 21. As seen in this figure, the extended portion 42 angles out forwardly from the rest of the side part 28 to place the pivot forward of back panel 21 and low enough to engage a seat of a boat in line with pivot 44 in hole 43. The exact shape of the extended portion 42 is not critical to the invention, as long as the extended portion 42 projects substantially out from the plane of the back panel 21 so that the opening 43 in the bottom section 42 is substantially forward of the plane back panel 21 to put pivot 44 forward of panel 21.

Figure 3:
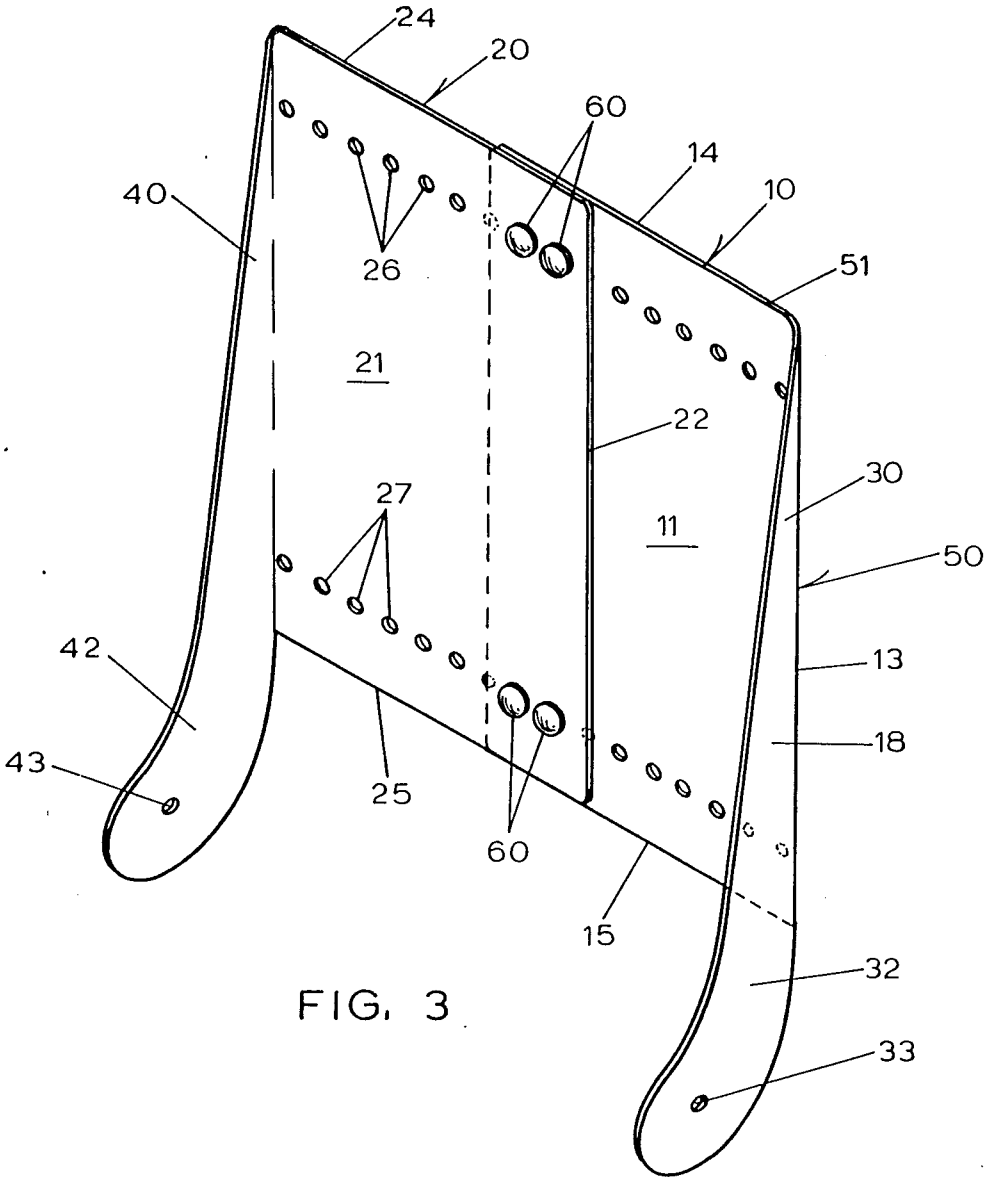
FIG. 3 is a right perspective view of the backrest as it appears when it is fastened together.

FIG. 3 shows that the right and left backrest sections 10 and 20 respectively, fastened together to form a completed backrest 50 having a top edge 14, 24 and bottom edge 15, 25. The two sections 10 and 20 are fastened together by overlapping the two sections 10 and 20 so that at least two openings 16 line up with at least two openings 26 and so that at least two openings 17 line up with at least two openings 27, and then inserting known fastening means 60 through the openings 16, 26, 17, and 27. Although in FIG. 3, section 10 is shown as being forward of section 20, either of the two sections 10 or 20 can be the forward section when they overlap. Also, although shown in FIG. 3 as being one particular size, the backrest 50 can be made smaller by increasing the area of overlap of the sections 10 and 20 and inserting known fastening means 60 through the lined up openings 16, 26, 17, and 27. Also, the invention envisions the use of a different number of fastening means 60.

FIG. 4 shows the invention in its folded position on the left and its upright position on the right. As seen in this figure, when the invention is in its folded position it lies substantially flat against the top of the rectilinear object 80 it is attached to, such as a boat seat. When the invention is in its upright position, the backrest 50 makes a right or slightly obtuse angle with the base 81 of the board or seat 80 it is attached to. The backrest 50 is fixed in place in its upright position by the bottom edge 52 of the backrest coming into contact with the base 81 of the seat 80. Backrest 50 is attached to the seat 80 at the sides 82 of the seat 80 by known fastening means 34, 44 inserted through openings 33 and 43 of the backrest 50 and through openings in the sides of the seat 80. The known fastening means 70 also allow the backrest 50 to be rotated from its folded position to its upright position using the fasteners as a pivot.

I claim:

1. A two-section backrest comprising:

a right backrest section;

a left backrest section;

said right and left backrest sections being mirror images of each other;

each backrest section having a substantially rectangular back panel, said back panels having a top edge, bottom edge, and free edge, each backrest section having a side panel connected to said back panel by a substantially right angle bend;

said side panels each having an extended portion which extends below the bottom of the back panel of its backrest section, said extended portion also extending substantially out from the plane of the back part of its section;

said back panels having openings which line up with each other when said back panels are over-lapped, allowing the two backrest sections to be fastened to each other by known fastening means inserted through said openings;

said extended portions of said side panels being capable of being fastened to a seat located between them when said back portions are attached together.

2. The device of claim 1 in which the seat is a cross beam in a boat.

3. The device of claim 1 where the openings are two sets of holes substantially parallel to the top and bottom of the back panels allowing said backrest to be assembled in a variety of widths.

4. The device of claim 1 in which the extended portion of each side panel has an opening which allows the backrest to be fastened by known fastening means to a seat located between said extended portions when said backrest is assembled.

5. The device of claim 1 in which the known fastening means allow the backrest to be pivoted into a folded position, said back panel lying substantially flat against said seat when said backrest is in a folded position.

6. The device of claim 5 in which the known fastening means allow the backrest to be pivoted into an upright position.

7. The device of claim 6 in which said back panel is at a slight acute angle to said seat when said backrest is in its upright position.

* * * * *